US009278496B2

(12) United States Patent
Sondaar

(10) Patent No.: US 9,278,496 B2
(45) Date of Patent: Mar. 8, 2016

(54) METHOD OF MANUFACTURING A FOLDABLE BAG AND A FOLDABLE BAG

(75) Inventor: Jaap Jeroen Sondaar, Woerdense Verlaat (NL)

(73) Assignee: Scholle Corporation, Northlake, IL (US)

( * ) Notice: Subject to any disclaimer, the term of this patent is extended or adjusted under 35 U.S.C. 154(b) by 1035 days.

(21) Appl. No.: 11/916,118

(22) PCT Filed: Jun. 2, 2006

(86) PCT No.: PCT/NL2006/050133

§ 371 (c)(1),
(2), (4) Date: Jan. 23, 2009

(87) PCT Pub. No.: WO2006/130008

PCT Pub. Date: Dec. 7, 2006

(65) Prior Publication Data

US 2009/0297073 A1 Dec. 3, 2009

(30) Foreign Application Priority Data

Jun. 2, 2005 (NL) ..... 1029173

(51) Int. Cl.
*B31B 19/36* (2006.01)
*B31B 7/00* (2006.01)
(Continued)

(52) U.S. Cl.
CPC . *B31B 19/36* (2013.01); *B31B 7/00* (2013.01); *B31B 29/00* (2013.01); *B65D 77/06* (2013.01);
(Continued)

(58) Field of Classification Search
CPC ..... B31B 19/36; B31B 7/00; B31B 29/00; B31B 77/06; B31B 2217/0076; B31B 2219/2627; B31B 2219/269
USPC ..... 493/195, 178, 179, 183, 243, 258, 244, 493/218, 228, 936, 197
See application file for complete search history.

(56) References Cited

U.S. PATENT DOCUMENTS 388,612 A 8/1888 Appel
2,556,661 A 6/1951 Rendall et al.
(Continued)

FOREIGN PATENT DOCUMENTS

AU 529320 B2 6/1983
DE u9316120.4 8/1955
(Continued)

OTHER PUBLICATIONS

Muinck, Office Action for U.S. Appl. No. 10/565,033, filed Jan. 17, 2006, mailed Dec. 4, 2008, pp. 1-12.
(Continued)

*Primary Examiner* — Sameh Tawfik
(74) *Attorney, Agent, or Firm* — The Watson I.P. Group, PLC; Jovan N. Jovanovic; Vladon M. Vasiljevic

(57) ABSTRACT

A method of manufacturing a foldable bag for use in a bag-in-box assembly is described. The foldable bag being manufactured according to this method has a folded condition in which it includes at least an inwardly creased bag portion in a longitudinal direction thereof. Furthermore, the bag includes a bottom edge and a top edge opposite to each other in a longitudinal direction of the bag. The inwardly creased bag portion has a first closed end and a second closed end opposite to each other in the longitudinal direction of it. The first and/or second closed end of the inwardly creased bag portion is a free end. The bag according to the invention has an improved unfolding process during filling it, and has such a configuration that it does not cause material stress in certain welded seams such as in known bags.

14 Claims, 4 Drawing Sheets

(51) Int. Cl.
*B31B 29/00* (2006.01)
*B65D 77/06* (2006.01)

(52) U.S. Cl.
CPC ... *B31B 2217/0076* (2013.01); *B31B 2219/269* (2013.01); *B31B 2219/2627* (2013.01); *B31B 2221/20* (2013.01)

(56) References Cited

U.S. PATENT DOCUMENTS

| | | | | | |
|---|---|---|---|---|---|
| 2,556,707 | A | | 6/1951 | Rendall et al. | |
| 3,023,679 | A | * | 3/1962 | Piazze | 493/194 |
| 3,089,622 | A | | 5/1963 | Westlake, Jr. | |
| 3,143,249 | A | * | 8/1964 | Merrill et al. | 222/105 |
| 3,496,059 | A | | 2/1970 | Ole-Bendt | |
| 3,827,341 | A | | 8/1974 | Stage | |
| 3,896,714 | A | | 7/1975 | Bosse | |
| 3,942,416 | A | | 3/1976 | Ackley et al. | |
| 4,866,786 | A | * | 9/1989 | Nagler | 383/101 |
| 4,889,523 | A | * | 12/1989 | Sengewald | 493/195 |
| 5,050,775 | A | * | 9/1991 | Marquardt | 222/93 |
| 5,067,636 | A | | 11/1991 | Pfeiffer et al. | |
| 5,102,384 | A | * | 4/1992 | Ross et al. | 493/243 |
| 5,149,315 | A | * | 9/1992 | Muhs | 493/189 |
| 5,673,664 | A | | 10/1997 | Lassanske | |
| 5,752,613 | A | | 5/1998 | Sasaki | |
| 5,759,144 | A | | 6/1998 | Derby | |
| 5,788,121 | A | | 8/1998 | Sasaki et al. | |
| 5,788,122 | A | | 8/1998 | Keller | |
| 5,851,072 | A | | 12/1998 | LaFleur | |
| 5,918,984 | A | | 7/1999 | LaFleur et al. | |
| 5,988,422 | A | | 11/1999 | Vallot | |
| 6,032,818 | A | | 3/2000 | Olson | |
| 6,056,681 | A | | 5/2000 | Ross | |
| 6,062,431 | A | | 5/2000 | Geshay | |
| 6,139,482 | A | | 10/2000 | LaFleur et al. | |
| 6,293,432 | B1 | | 9/2001 | Hartwell | |
| 7,980,410 | B2 | | 7/2011 | De Muinck | |
| 2006/0180589 | A1 | | 8/2006 | De Muinck | |
| 2009/0297073 | A1 | | 12/2009 | Sondaar | |

FOREIGN PATENT DOCUMENTS

| | | | |
|---|---|---|---|
| DE | 2256913 | A1 | 5/1974 |
| DE | 4204902 | A1 | 8/1992 |
| DE | 4316865 | | 11/1993 |
| DE | 10214712 | A1 | 10/2003 |
| EP | 0493332 | | 7/1992 |
| EP | 0642453 | | 1/1996 |
| EP | 0642453 | B1 | 1/1996 |
| GB | 540564 | A | 10/1941 |
| GB | 2117736 | | 10/1983 |
| JP | 02191171 | | 7/1990 |
| WO | WO 93/13936 | | 7/1993 |
| WO | WO9324389 | | 12/1993 |
| WO | WO 2004/022440 | | 3/2004 |
| WO | WO 2006/130008 | A | 12/2006 |

OTHER PUBLICATIONS

Muinck, Office Action for U.S. Appl. No. 10/565,033, filed Jan. 17, 2006, mailed Apr. 23, 2009 , pp. 1-13.
Muinck, Advisory Action for U.S. Appl. No. 10/565,033, filed Jan. 17, 2006, mailed Aug. 3, 2009, pp. 1-3.
Muinck, Office Action for U.S. Appl. No. 10/565,033, filed Jan. 17, 2006, mailed Dec. 18, 2009, pp. 1-15.
Muinck, Notice of Allowance for U.S. Appl. No. 10/565,033, filed Jan. 17, 2006, mailed Jul. 2, 2010, pp. 1-10.
Muinck, Notice of Allowance for U.S. Appl. No. 10/565,033, filed Jan. 17, 2006, mailed Mar. 17, 2011, pp. 1-9.
International Preliminary Examination Report of the European Patent Office for PCT/NL03/00533, filed Jul. 18, 2003.
International Search Report of the European Patent Office for PCT/NL03/00533, filed Jul. 18, 2003.
Official Search Report of the European Patent Office Patent Office in counterpart foreign application No. PCT/NL2006/050133 filed Jun. 2, 2006.
Written Opinion of the European Patent Office Patent Office in counterpart foreign application No. PCT/NL2006/050133 filed Jun. 2, 2006.
Ebo Jacques De Muinck, Office Action mailed Oct. 15, 2010, U.S. Appl. No. 10/565,033, filed Jan. 17, 2006.
Restriction Requirement for U.S. Appl. No. 11/916,118, filed Jan. 23, 2009, mailed Jun. 10, 2011.
Restriction Requirement for U.S. Appl. No. 11/916,118, filed Jan. 23, 2009, mailed Jul. 19, 2011.
Office Action for U.S. Appl. No. 11/916,118, filed Jan. 23, 2009, mailed Dec. 27, 2011.
Final Office Action for U.S. Appl. No. 11/916,118, filed Jan. 23, 2009, mailed Jul. 6, 2012.
European Search Report and Written Opinion of the European Patent Office in foreign Application No. PCT/EP2010/055838, filed Apr. 29, 2010.

* cited by examiner

METHOD OF MANUFACTURING A FOLDABLE BAG AND A FOLDABLE BAG

CROSS-REFERENCE TO RELATED APPLICATION

The present application is a Section 371 National Stage Application of and claims priority of International patent application Serial No. PCT/NL2006/050133, filed Jun. 2, 2006, and published as WO 2006/130008 in English.

BACKGROUND

The discussion below is merely provided for general background information and is not intended to be used as an aid in determining the scope of the claimed subject matter.

The present invention relates to a method of manufacturing a foldable bag for use in a bag-in-box assembly, the foldable bag having a folded condition in which it includes at least an inwardly creased bag portion in a longitudinal direction thereof.

Such a method is known from the international application WO 2004/022440. According to the known method a foldable bag is manufactured, which has, in a folded condition, a rectangular shape and two inwardly creased bag portions in its longitudinal direction at opposite sides of the bag. The bag is composed of four sheets. The four sheets are positioned with respect to each other according to a predetermined pattern and welded at a bottom side and a top side which are opposite to each other in longitudinal direction of the bag such that the inwardly creased bag portions are created along two side edges opposite to each other in lateral direction of the bag.

The bag thus manufactured is fixed to a box. In mounted condition a lower part of the bag in the box lies on the bottom of the box. Each inwardly creased bag portion forms one compartment in the bag below and one above the inwardly creased bag portion. During filling of the bag with a liquid it should be unfolded and obtain the shape of the container. During filling of the bag the liquid may flow into the compartments of the bag which are located above as well as below the inwardly creased bag portions. If the compartment of the bag above the inwardly creased bag portion is filled more quickly than that below it, the liquid contained in the compartment above the inwardly creased bag portion will press thereon such that filling of the lower compartment becomes more difficult. It is observed that this effect may result in incomplete unfolding of the bag.

SUMMARY OF THE INVENTION

This Summary and Abstract are provided to introduce some concepts in a simplified form that are further described below in the Detailed Description. This Summary and Abstract are not intended to identify key features or essential features of the claimed subject matter, nor are they intended to be used as an aid in determining the scope of the claimed subject matter. In addition, the description herein provided and the claimed subject matter should not be interpreted as being directed to addressing any of the short-comings discussed in the Background.

A method comprises the steps:

providing a flexible bag comprising a front sheet and a back sheet which are circumferentially joined to each other, which bag has an unfolded condition in which it includes at least a side edge, displacing the front sheet and the back sheet away from each other in at least a region of displacement extending on each of the sheets remote from the side edge, hence creating a space between the front and back sheet in at least the region of displacement, displacing the side edge in the direction of the space so as to form two double-walled flaps, each extending substantially perpendicularly to the side edge, moving the flaps to each other when the side edge has reached a predetermined position between the front and back sheet of the bag, thus forming an inwardly creased bag portion in the longitudinal direction of the bag.

This method enables to manufacture a foldable bag wherein the inwardly creased bag portion forms compartments in the bag between this portion and the front sheet and between this portion and the back sheet, which compartments communicate along the entire circumferential edge of the inwardly creased bag portion. This means that the flow capacity between both compartments is relatively high. It has been observed that due to this effect the unfolding process during filling of a bag has improved such that the bag unfolds entirely.

The front sheet and back sheet may be displaced away from each other by engaging each of the sheets in the region of displacement and pulling them away from each other. The advantage of this method is that it enables to apply a relatively simple automation step within the manufacturing method. The sheets can be engaged by applying a suction force thereon, which can be applied by a vacuum tool, for example. It should be noted that if the front sheet and back sheet are displaced away from each other the side edge is automatically displaced in the direction of the space which is created between the front sheet and the back sheet.

The front sheet and back sheet can be made of walls which are composed of several film layers, which are at least locally joined at least before displacing the front and back sheet with respect to each other. This facilitates the engagement of all the film layers of each sheet together. If, for example, the sheets are engaged by a vacuum tool it is desired to engage the different film layers of one sheet together.

The film layers may be locally joined by applying spot welds on the front sheet and the back sheet. This is a simple method of locally adhering the different film layers.

The spot welds can be applied at locations which are spaced from each other as viewed perpendicular to the front and back sheet when the bag in unfolded condition extends in a flat plane. The advantage of applying the spot welds according to this pattern is that the spot welds of the front and back sheet cannot stick to each other, which would make it more difficult to pull the front sheet and back sheet away from each other.

Alternatively, the front sheet and back sheet may be displaced away from each other by slightly inflating the bag before displacing the side edge, wherein the flaps tan be moved to each other during deflating the bag. This step facilitates the displacement of the sheets since sticking of the sheets to each other is avoided.

The invention also relates to a foldable bag for use in a bag-in-box assembly, wherein the bag has a folded condition when it is empty. In this condition the bag includes a bottom edge and a top edge opposite to each other in a longitudinal direct-ion of the bag, and at least an inwardly creased bag portion in the longitudinal direction of the bag, which bag portion has a first closed end and a second closed end opposite to each other in the longitudinal direction of this bag portion. The bag is characterized in that the first and/or second closed end of the inwardly creased bag portion is a free end. These features surprisingly improve the unfolding process of the bag, such as described hereinbefore. Besides, a simple bag configuration is provided.

Moreover, due to these features stress concentrations in welded seams of the bag during filling thereof are prevented, These stress concentrations could occur in a bag of which the closed ends of the inwardly creased bag portion are welded to the bottom edge and/or the top edge of the bag. In practice, the stress concentration may be too high, resulting in cracking of the bag and leakage problems. Due to the ends of the inwardly creased bag portion being free it may and will displace entirely in outward direction without having stress points during filling, hence overcoming the mentioned problems.

It is noted that the European patent EP 0 642 453 B1 discloses a method of folding a lining for a container. The lining is, however, folded by folding corner flaps onto the outer surface of the lining. Thus, the lining does not include inwardly creased bag portions.

BRIEF DESCRIPTION OF THE DRAWINGS

The invention and advantages thereof will now be explained in more detail with reference to the very schematic drawings.

DETAILED DESCRIPTION

Figure 1:
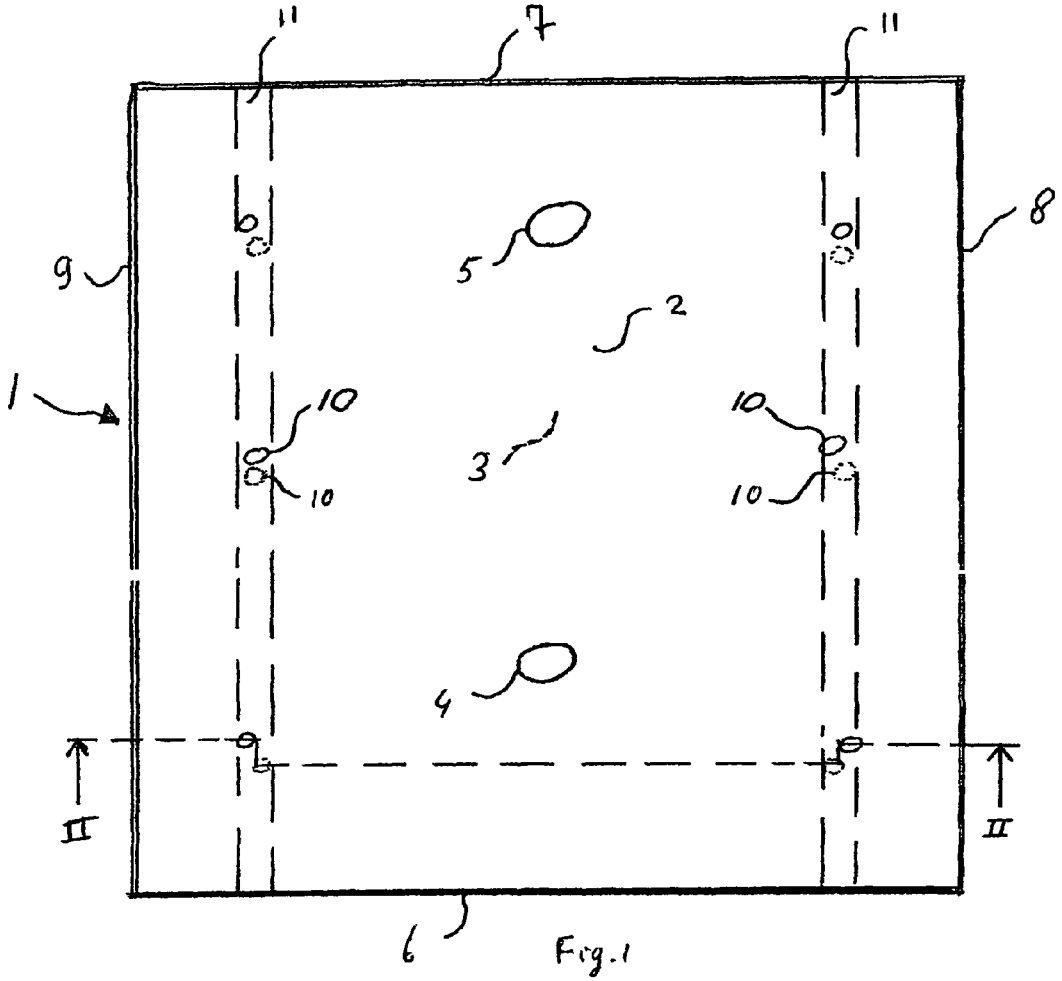
FIG. 1 is a very schematic front view of an embodiment of a foldable bag according to the invention, illustrating its configuration in unfolded condition.

FIG. 1 shows an embodiment of a foldable bag 1 in an unfolded condition. The bag 1 comprises only a rectangular front sheet 2 and back sheet 3, both of similar size. The front sheet of this embodiment is provided with a first opening 4 and a second opening 5 which serve as inlet and outlet of the bag.

The front sheet 2 and the back sheet 3 are circumferentially joined to each other, i.e. along a bottom edge 6, a top edge 7, a first side edge 8 and a second side edge 9. The front and back sheet 2, 3 can be joined by heat-welding, for example. The front and back sheet 2, 3 of the bag 1 may be made of polyethylene.

Figure 2:
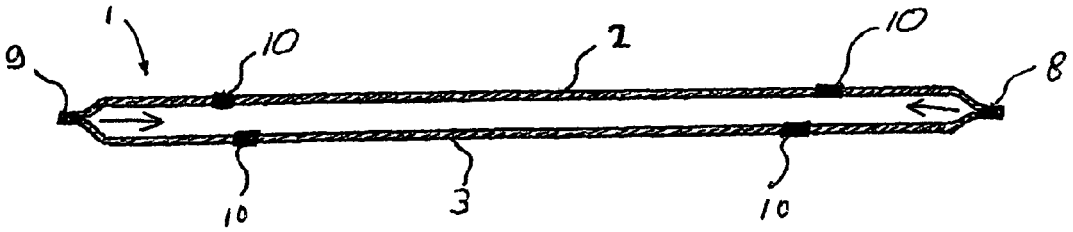
FIG. 2 is a cross-sectional view along the line II-II in FIG. 1.

The sheets 2, 3 may each comprise more than one film layer. The advantage of applying a sheet comprising multiple thin layers instead of a sheet comprising only one thick layer is that the former appears to be more flexible, while it has a higher resistance against breaking if a sharp object contacts the sheet. Moreover, a sheet comprising multiple thin layers is less sensitive to local breaking after creasing the sheet. In order to facilitate the engagement of the sheets 2, 3 before applying the folding process it is preferred to join the different film layers together at certain locations, especially in those locations where the sheets are engaged by a tool (not shown), for example. This avoids the problem that not all of the layers of one sheet are engaged together before displacement of the sheet. The film layers may be joined by applying spot welds 10 on the sheets 2, 3, such as illustrated in FIGS. 1-4. The spot welds 10 are preferably located near regions of displacement 11 which extend substantially parallel to the side edges 8, 9. The spot welds 10 on the front sheet 2 and back sheet 3 are spaced from each other as viewed perpendicularly to the surface of the front and back sheet 2, 3 when the bag 1 lays on a flat plane, such as shown in FIGS. 1 and 2. The spot welds 10 are spaced apart to prevent them from sticking to each other. This would make displacement of the sheets 2, 3 away from each other more difficult.

Figure 3:
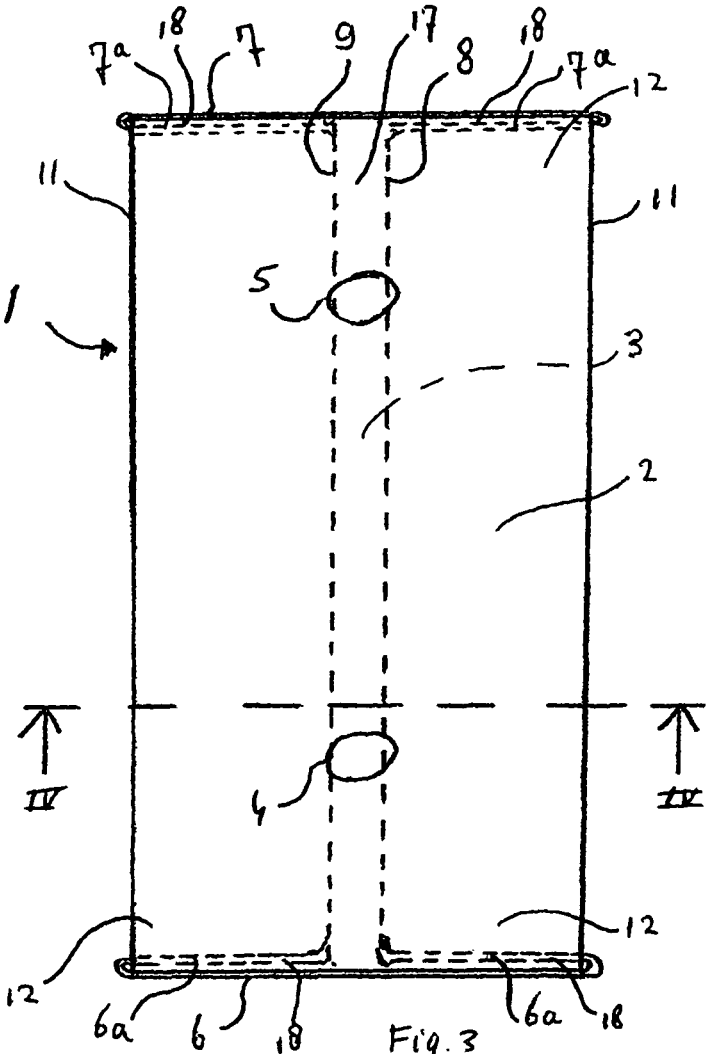
FIG. 3 is a very schematic front view of the embodiment of FIG. 1, illustrating the bag in a folded condition.
Figure 4:
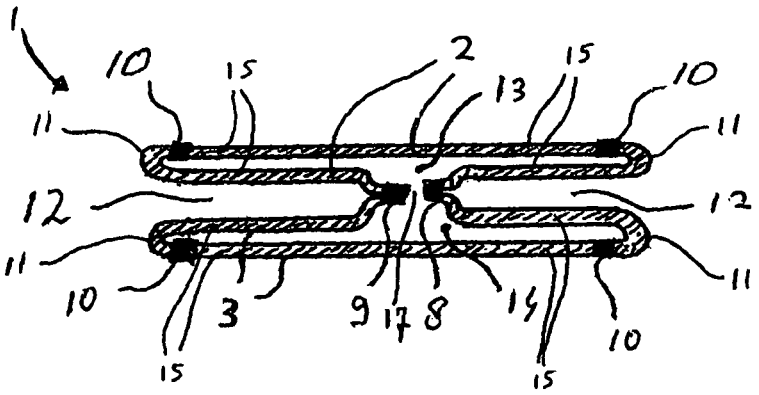
FIG. 4 is a cross-sectional view along the line IV-IV in FIG. 3.

There are several ways to apply a method so as to obtain the embodiment of the bag 1 such as shown in FIGS. 3 and 4. Displacing the front sheet 2 and back sheet 3 away from each other may be performed by hand, whereas the side edge 8, 9 can also be displaced inwardly of the bag 1 by hand.

It is also possible to engage the sheets 2, 3 by a vacuum tool, for example, which pulls the sheets 2, 3 away from each other after engaging them by a suction force. If the bag 1 is air tight and a vacuum is created therein the side edge 8, 9 will automatically move inwardly when the front sheet 2 and back sheet 3 are displaced away from each other. This process can be imagined by engaging the front sheet 2 and back sheet 3 in the region of displacement 11 and pulling them away from each other until the edge 8, 9 has been displaced to the original region of displacement 11, see FIG. 1. In that case double-walled flaps 15 are formed which extend perpendicularly to the side edge. When the flaps 15 are moved to each other the inwardly creased bag portion 12 is formed, such as shown in FIG. 4.

It is also conceivable that the side edge 8, 9 is displaced between the first sheet 2 and the back sheet 3 without explicitly displacing the front sheet 2 and the back sheet 3 away from each other. Of course, a small space between the sheets 2, 3 must be present, but it can be created simultaneously with and as a consequence of displacing the side edge 8, 9 inwardly.

Alternatively, the bag 1 can be inflated slightly so as to create automatically a displacement between the front sheet 2 and the back sheet 3 which facilitates displacing the side edge 8 inwardly of the bag 1. After or during the displacement of the side edge 8 the bag 1 can be deflated so as to obtain a vacuum in the bag 1.

A configuration of the foldable bag 1 of FIG. 1 after applying the manufacturing method is shown in FIGS. 3 and 4. The first side edge 8 and the second side edge 9 are folded inwardly of the bag. As a result, the side edges 8, 9 face to each other and the regions of displacement 11 shown in FIG. 1 form side edges of the bag 1 in folded condition. The inwardly creased bag portions 12 in the bag 1 form a front compartment 13 and a back compartment 14. Furthermore, the inwardly creased bag portions 12 have a first closed end 6*a* located near the bottom edge 6 and a second closed end 7*a* located near the top edge 7. The first and second closed ends 6*a*, 7*a* are formed by the parts of the bottom edge 6 and the top edge 7 which are folded inwardly, respectively.

The front compartment 13 is substantially enveloped by the front sheet 2, whereas the back compartment 14 is substantially enveloped by the back sheet 3. The front compartment 13 and back compartment 14 are communicating through a first flow-through opening 17 between the first and second side edge 8, 9, whereas they are also communicating through a second flow-through opening 18 between the bottom edge 6 and the first closed end 6*a* of the inwardly creased bag portions 12, and between the top edge 7 and the second closed end 7*a* of the inwardly creased bag portions 12, such as shown in FIG. 3.

Figure 5:
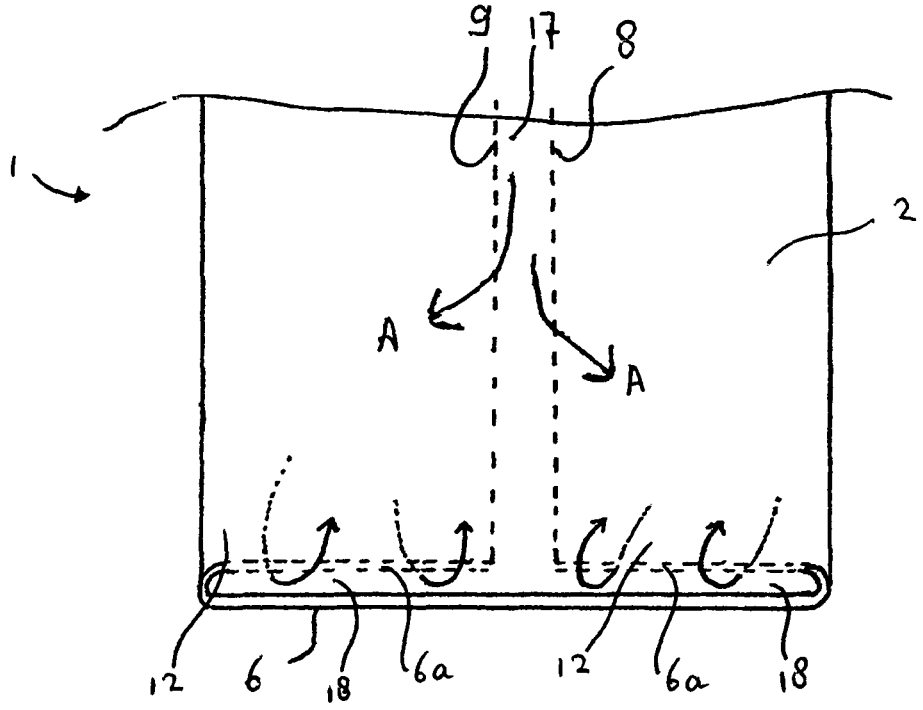
FIG. 5 is a partial view of FIG. 3 on a larger scale, illustrating a possible flow direction of a liquid during filling of the bag.

FIG. 5 shows a possible flow direction of a liquid during filling of the bag. The liquid can flow from the back compartment 14 to the front compartment 13 through the second flow-through opening 18 between the bottom edge 6 and the first closed end 6*a* of the inwardly creased bag portions 12, such as illustrated by arrows B. The liquid can also flow from the back compartment 14 to the front compartment 13 through the first flow-through opening 17, such as illustrated by arrows A. It can be seen that the front compartment 13 and the back compartment 14 communicate along the entire circumferential edge 6*a*, 8, 7*a* and 6*a*, 9, 7*a* of the inwardly creased bag portions 12.

Figure 6A:
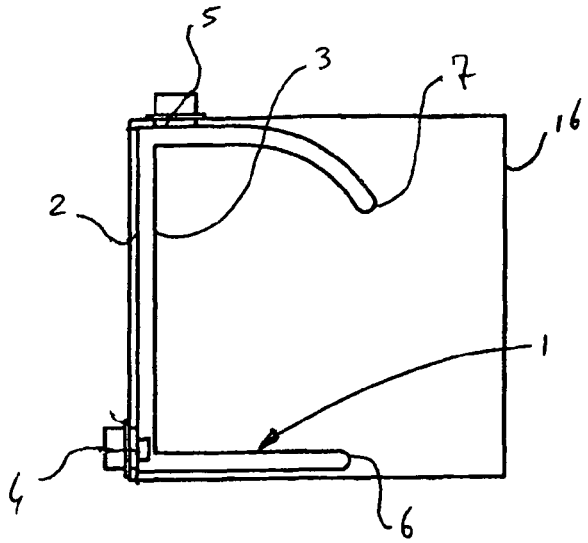
FIGS. 6*a-c* are very schematic sectional side views of the bag of FIG. 3 in a box, illustrating an unfolding process of the bag during filling it in an initial state (FIG. 6*a*), an intermediate state (FIG. 6*b*) and a final state (FIG. 6*c*).
Figure 6B:
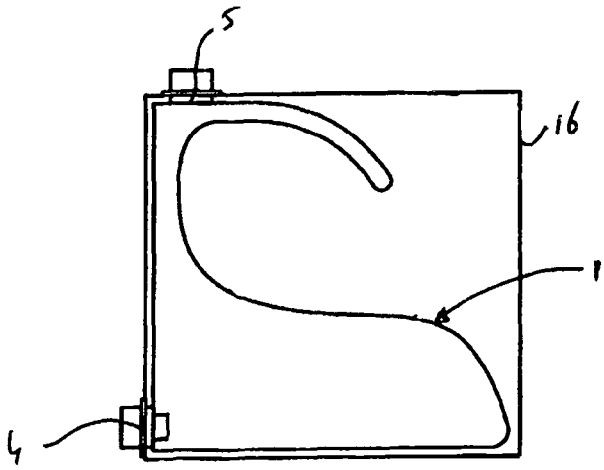
Figure 6C:
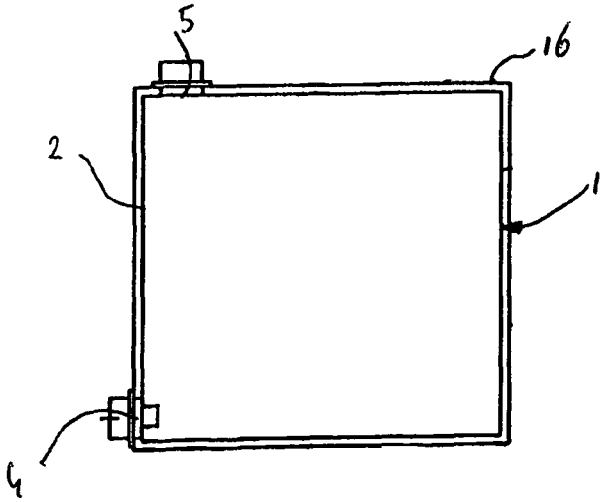

FIGS. 6*a-c* illustrate the filling process of the foldable bag 1 when it is mounted in a box 16 so as to form a bag-in-box combination. The first sheet 2 of the bag 1 may be fixed to the box, for example near the first opening 4 at one side of the box 16 nearby its bottom, and near the second opening 5 at the top side of the box, respectively, such as shown in FIGS. 6*a-c*. A fixation of the bag 1 to the box 16 may be combined with a fixation of valves, that can be secured into the openings 4, 5 of the bag 1, to the box 16.

FIG. 6*a* shows the initial state of the bag 1 when it is still empty. When filling the bag 1 with a liquid through opening 5 the liquid can flow downwardly in the bag 1 through the first flow-through opening 17, which operates as a channel between the inwardly creased bag portions 12. When arriving at the bottom of the box 16 the liquid may flow in the direction of the bottom edge 6 of the bag 1. When filling the bag through the opening 4 the liquid may also flow in the direction of the bottom edge 6 of the bag 1. The liquid may flow into and fill the compartments 13, 14, such as explained hereinbefore with reference to FIG. 5. During filling of the bag 1 the compartments 13, 14 will be filled and simultaneously unfold the bag 1. FIG. 6*b* shows an intermediate state during the filling process. The bag 1 unfolds until it obtains the internal shape of the box 16. The filled condition of the bag 1 is shown in FIG. 6*c*.

It is also possible that the bag 1 is not fixed to the box 16 or only fixed near the bottom, for example at the first opening 4, see FIG. 6*a*. When filling the bag via the first opening 4 in that case the bag 1 unfolds from the bottom.

In any case, whether the bag is fixed to the box or not, due to the features of the bag 1 according to the invention the liquid will flow easier between the front and back compartment 13, 14, hence providing an effective unfolding process.

From the foregoing it will be clear that the invention provides a method of manufacturing a foldable bag for use in a bag-in-box assembly. The bag which is manufactured according to this method unfolds entirely during filling it. Besides, due to the configuration of the bag stress concentrations in welded seams after filling of the bag, such as the case in known foldable bags, are avoided.

The invention is not restricted to the above-described embodiment as shown in the drawings. It may be apparent that various changes can be made in the embodiment without departing from the scope of the claims.

The invention claimed is:

1. A method of manufacturing a foldable bag for use in a bag-in-box assembly, the foldable bag having a folded condition in which it includes at least an inwardly creased bag portion in a longitudinal direction thereof, the method comprising:

providing a flexible bag comprising a front sheet and a back sheet wherein each sheet includes an inner surface and an outer surface, a left side edge, a right side edge, a top side edge and a bottom side edge wherein each corresponding edge of the inner surface of the front sheet and is joined together to the inner surface of the back sheet about each of the left side edge, the right side edge, the top side edge and the bottom side edge thereof to define a sealed cavity, which bag has an unfolded condition in which it includes at least either the right side edge or the left edge and substantially the entire portion of the inner surface of the front sheet within the cavity abuttingly overlying substantially the entire portion of inner surface of the back sheet within the sealed cavity, displacing the front sheet and the back sheet away from each other in at least a region of displacement extending on each of the sheets remote from the left and right side edge, hence creating a space between the front and back sheet in at least said region of displacement, displacing either the left side edge or the right side edge in the direction of said space, with the top side edge sliding inwardly over itself forming a top flow-through opening therebetween and the bottom edge sliding inwardly over itself so as to have a portion of the inner surface of the front sheet within the cavity abuttingly overlying itself, and so as to have a portion of the inner surface of the back sheet within the cavity abuttingly overlying itself, and defining a bottom flow-through opening therebetween so as to form two double-walled flaps, each extending substantially perpendicularly to the left or right side edge, thus forming an inwardly creased bag portion in the longitudinal direction of the bag returnable to the unfolded condition; and moving the flaps to each other when the left or right side edge has reached a predetermined position between the front and back sheet of the bag wherein the bag is structurally configured to entirely unfold into the unfolded condition when filled with a liquid.

2. The method according to claim 1, wherein the front sheet and back sheet are displaced away from each other by engaging each of the sheets in said region of displacement and pulling them away from each other.

3. The method according to claim 2, wherein the sheets are engaged by applying a suction force thereon, which can be applied by a vacuum tool.

4. The method according to claim 1, wherein the front sheet and back sheet are made of walls which are composed of several film layers, which are at least locally joined at least before displacing the front and back sheet with respect to each other.

5. The method according to claim 4, wherein the film layers are locally joined by applying spot welds on the front sheet and the back sheet.

6. The method according to claim 5, wherein the spot welds are applied at locations which are spaced from each other as viewed perpendicular to the front and back sheet when the bag in unfolded condition extends in a flat plane.

7. The method according to claim 6, wherein the spot welds are applied in said region of displacement on the front and back sheet.

8. The method according to claim 1, wherein the front sheet and back sheet are displaced away from each other by slightly inflating the bag before displacing the left or right side edge, and wherein the flaps are moved to each other during deflating the bag.

9. The method according to claim 1, and further comprising:

displacing both the left side edge and the right side edge in the direction of said space so as to form left and right two double-walled flaps, each extending substantially perpendicularly to the left and right side edge, thus forming an inwardly creased bag portion in the longitudinal direction of the bag; and moving both flaps to each other when each of the left and right side edges have reached predetermined positions between the front and back sheet of the bag.

10. The method according to claim 1 and further comprising:

providing a first opening in the front sheet configured to allow the liquid into the space between the front sheet and the back sheet.

11. The method according to claim 1 and further comprising:

providing a second opening in the front sheet configured to allow the liquid to be dispensed from the space between the front sheet and the back sheet.

12. The method according to claim 1 and wherein the front and back sheets are of the same material.

13. The method according to claim 1 and wherein a width and a length of the front and back sheet are substantially the same.

14. The method according to claim 1 and wherein when forming the two double- walled flaps, the joined left side edges or the joined right side edges is located between the two double-walled flaps.

* * * * *